US005109178A

United States Patent [19]

Yoshida et al.

[11] Patent Number: 5,109,178

[45] Date of Patent: Apr. 28, 1992

[54] SPARK PLUG FOR INTERNAL COMBUSTION ENGINE

[75] Inventors: Mitsutaka Yoshida; Akihiro Toya; Akihisa Harada; Eigo Goto; Makoto Sugimoto; Toru Moriya, all of Nagoya, Japan

[73] Assignee: NGK Spark Plug Co., Ltd., Aichi, Japan

[21] Appl. No.: 742,533

[22] Filed: Aug. 8, 1991

Related U.S. Application Data

[63] Continuation of Ser. No. 499,608, Mar. 27, 1990, abandoned.

[30] Foreign Application Priority Data

Mar. 28, 1989 [JP] Japan ..... 1-73851
Mar. 28, 1989 [JP] Japan ..... 1-73852

[51] Int. Cl.[5] ..... H01T 13/20; H01T 13/38

[52] U.S. Cl. ..... 313/137; 313/143; 313/131 A

[58] Field of Search ..... 313/137, 143, 131 A

[56] References Cited

U.S. PATENT DOCUMENTS 3,365,605 1/1968 Linstedt ..... 313/137
4,267,483 5/1981 Nakajima et al. ..... 313/143
4,337,408 6/1982 Sone et al. ..... 313/143 X
4,415,828 11/1983 Mizuno et al. ..... 313/143 X
4,427,914 1/1984 Mizuno et al. ..... 313/118 X
4,937,484 6/1990 Ishino ..... 313/143

FOREIGN PATENT DOCUMENTS 2109415 9/1972 Fed. Rep. of Germany .
3152877 8/1985 Fed. Rep. of Germany .
43142 4/1978 Japan .

OTHER PUBLICATIONS

Patent Abstracts of Japan, vol. 2, No. 78 (M-78) (1860) Jun. 21, 1978, and JP-A-53 43142 (Nippon Tokushu Togyo K.K.) Apr. 19, 1978.

*Primary Examiner*—Palmer C. DeMeo
*Attorney, Agent, or Firm*—Wegner, Cantor, Mueller & Player

[57] ABSTRACT

A spark plug for an internal combustion engine is disclosed. A semiconductor material having a resistance of $5\times10^2-5\times10^4$ MΩ/mm is coated or baked in the form of a band on the peripheral surface of a basal part of a leg portion of an insulator of the spark plug. Preferably, at least the basal part of the leg portion, including the band, is covered with a water-repellant insulating coating. An inner wall of a metal shell of the spark plug is desirably coated with a water-repellant material at an area facing at least the peripheral surface of the basal part of the leg portion of the insulator.

15 Claims, 7 Drawing Sheets

SPARK PLUG FOR INTERNAL COMBUSTION ENGINE

This application is a continuation of U.S. application Ser. No. 07/499,608, filed Mar. 27, 1990, now abandoned.

BACKGROUND OF THE INVENTION a) Field of the Invention

The present invention relates to a spark plug for an internal combustion engine, especially to a spark plug assuring fail-free ignition over a long period of time.

b) Description of the Related Art

Since an air-fuel mixture is enriched from the starting of an internal combustion engine until the completion of warming-up, carbon formed as a result of combustion of the fuel may deposit in a large quantity together with the liquid fuel on a leg portion of an insulator of a conventional spark plug. The carbon thus deposited on the leg portion of the insulator may then be oriented under electric forces (impressed voltages), whereby a path of carbon may extend from a basal part of the leg portion, i.e., a ground side toward a free end of the leg portion and the insulation resistance of the insulator may hence be lowered. This may cause engine troubles. With a view toward removing carbon deposited as described above and also promoting the self-cleaning action of the insulator itself, the leg portion of the insulator is made longer to prevent the insulation resistance from being lowered, and/or a highly water-repellant material such as silicone oil is coated to the surface of the insulator and/or the inner wall of the metal shell so as to avoid the formation of water which induces the deposition of carbon.

When the leg portion of the insulator is made longer to facilitate the rise of the surface temperature of the insulator, the insulator can maintain insulation resistance against the deposition of carbon due to combustion of the fuel. The thus-lengthened leg portion is therefore effective for improving the smear resistance. However, the leg portion thus lengthened tends to induce pre-ignition. A limitation is also imposed on the length of the leg portion from the standpoint of heat resistance. In the case of a spark plug in which the surface of an insulator and the inner wall of a metal shell are coated with a highly water-repellant material such as silicone oil, the highly-water repellant material such as silicone oil is caused to gradually evaporate and its effect for the elimination of water and the like is lost in a short time when repeatedly exposed to hot combustion gas.

SUMMARY OF THE INVENTION

An object of the present invention is to improve the above-described drawbacks of the conventional spark plugs, and specifically to prevent carbon, which is formed upon combustion, from depositing on a leg portion of an insulator of a spark plug, thereby avoiding the reduction of insulation resistance and hence maintaining fail-free ignition of the spark plug.

In one aspect of the present invention, there is thus provided a spark plug for an internal combustion engine. The spark plug has a metal shell and an insulator. The metal shell defines a through hole and a shoulder seat, and has threads for mounting the spark plug on the internal combustion engine. The insulator is disposed inside the through hole of the metal shell and is fixed on the shoulder seat, and holds a center electrode therein. The insulator has a leg portion extending from the shoulder seat into a combustion chamber of the internal combustion engine when the spark plug is mounted on the internal combustion engine. A semiconductor material having a resistance of $5\times10^2-5\times10^4$ MΩ/mm is applied, for example, coated or baked in the form of a band on the peripheral surface of a basal part of the leg portion of the insulator. Preferably, the band of the semiconductor material may be imparted with water repellency. The leg portion of the insulator, including the band, may be covered by a water-repellant insulating coating. The inner wall of the metal shell may be coated with a water-repellant material at an area facing at least the band on the leg portion of the insulator.

The band of the semiconductor material is effective for preventing the orientation of carbon even when carbon deposits together with water and the like on the surface of the insulator. The formation of water can be minimized by making the band water-repellant and/or by coating the water-repellant material on the inner wall of the metal shell, so that the resistance of the surface of the insulator to carbon smear can be improved further. It is therefore possible to avoid the reduction of insulation resistance.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE INVENTION AND PREFERRED EMBODIMENTS

Figure 1:
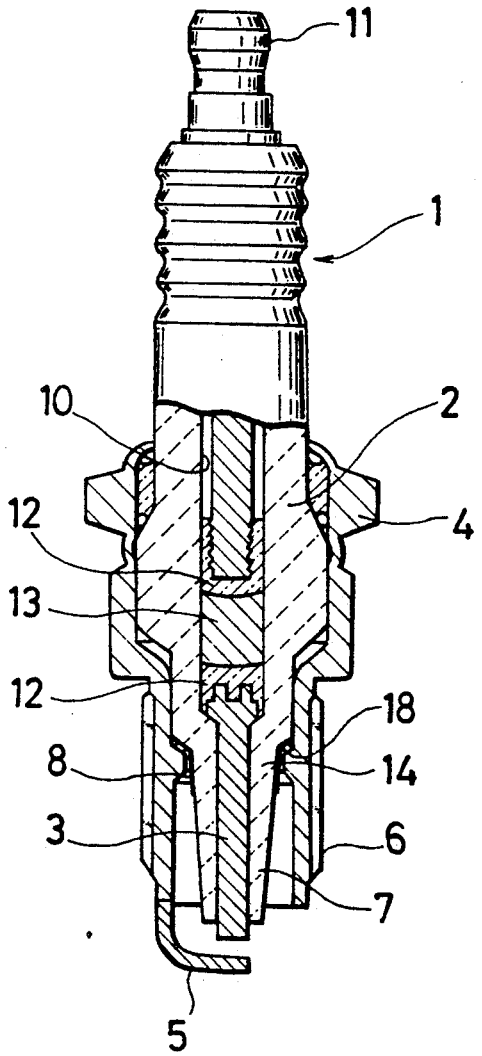
FIG. 1 is a partly cross-sectional view of a spark plug according to a first embodiment of the present invention, which is suited for use in an internal combustion engine.
Figure 2:
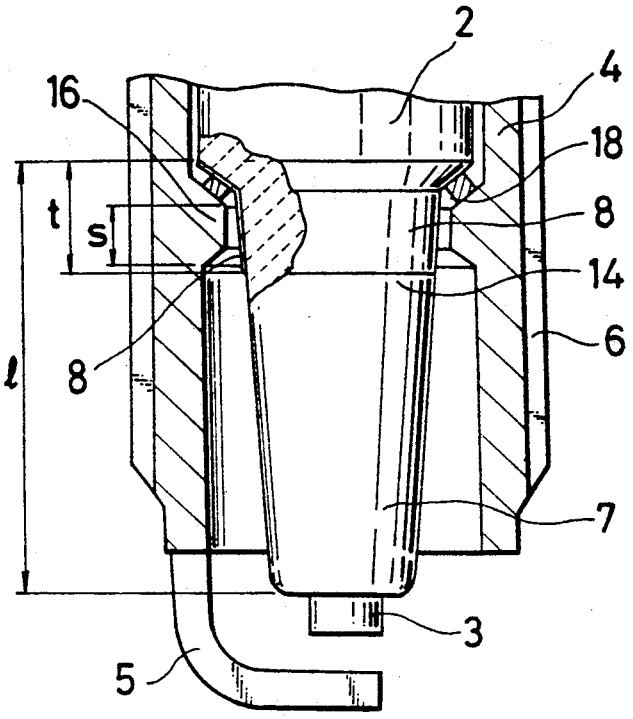
FIG. 2 is an enlarged, partly cross-sectional, fragmentary view of the spark plug according to the first embodiment.

In FIG. 1, numeral 1 indicates the spark plug according to the first embodiment of the present invention. This spark plug 1 is composed of an insulator 2 having a center electrode 3 at a free end thereof and a metal shell 4 having a ground electrode 5 located at a position opposite to the center electrode 3 and threads 6 employed upon mounting the spark plug on an unillustrated internal combustion engine. Numeral 11 indicates a terminal electrode, which is sealed together with a resistor 13 within an axial cavity 10 formed in the insulator 2 with a glass sealing interposed between the terminal electrode 11 and the resistor 13. The insulator 2 is fixed on a shoulder seat 18 formed in a through hole of the metal shell 4. As is shown in FIG. 2, a band 7 of a semiconductor material having a resistance of $5\times10^2-5\times10^4$ MΩ/mm is coated or baked on the insulator 2 holding the center electrode 3 at the free end thereof, especially on the surface of a basal part 14 of a leg portion 7 of the insulator 2, said leg portion 7 extending from the shoulder seat 18 into a combustion chamber when the spark plug 1 is mounted on the unillustrated internal combustion engine (the first embodiment). This band (8) of the semiconductor material has been formed by mixing alumina or silica as a principal component with 0.1-5% of the semiconductor material [$TiO_2$, $Nb_2O_5$, $ZrO_2$, $BaTiO_3$, $IrO_2$, or a ferrite represented by $MO.Fe_2O_3$ (M: Mn, Mg, Ni, Co, Cu, Zn or the like)], coating the mixture, drying the thus-coated mixture in the air for 1 hour and then baking it at 100°-300° C. When carbon is formed by combustion and is about to be deposit together with fuel, water or the like on the surface of the insulator 2, the provision of the band 8 of the semiconductor material having the resistance of $5\times10^2-5\times10^4$ MΩ/mm on the insulator 2, in particular, on the surface of the basal part 14 of the leg portion 7 of the insulator 2 has made it possible to prevent the carbon, water and the like from being electrically oriented by impressed voltages. It is hence possible to avoid the reduction of insulation resistance, which would otherwise occur due to deposition of carbon on the surface of the insulator 2.

The smear preventing effect of the band 8 of the semiconductor material coated or baked on the surface of the insulator 2 can be brought about when its axial length is not greater than one third of the axial length (l) of the leg portion 7. The band 8 cannot exhibit smear preventing effect if it is longer than the above upper limit (the second embodiment).

Figure 3:
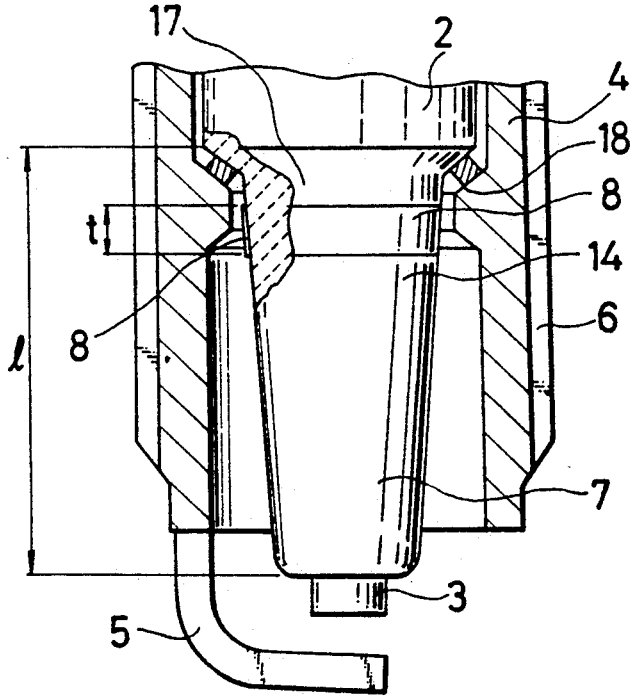
FIG. 3 is an enlarged, partly cross-sectional, fragmentary view of a spark plug according to a third embodiment of the present invention.

The band 8 of the semiconductor material can be formed on the basal part 14 other than a root part 17 by coating or baking as shown in FIG. 3 (the third embodiment). This form of band 8 can exhibit still better smear resistance because a path of carbon extended from the root part 17 is interrupted by the band 8 and the band 8 also serves to retard the extension of a path of carbon from the band 8 toward the free end of the leg portion 7 of the insulator 2.

Figure 4:
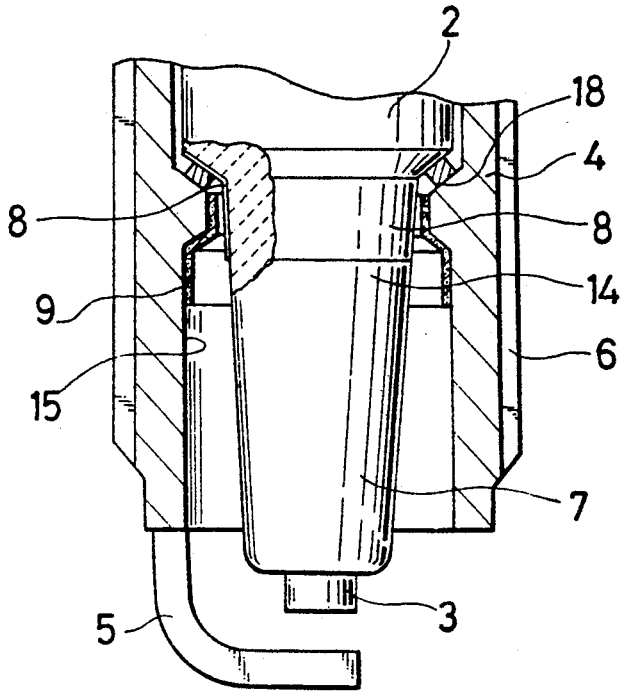
FIG. 4 is an enlarged, partly cross-sectional, fragmentary view of a spark plug according to a fifth embodiment of the present invention.

The band 8 made of the semiconductor material coated or baked on the insulator 2, especially, on the surface of the basal part 14 of the leg portion 7 of the insulator 2, said leg portion 7 extending from the shoulder seat 18 into a combustion chamber when the spark plug 1 is mounted on an internal combustion engine can be imparted with water repellency by coating a mixture of silicone or a silicone varnish and boron nitride, said mixture containing 2-5% of carbon black, drying the mixture and then baking the thus-dried mixture or by using TEFLON (trade mark) or the like as a base material to improve the heat resistance. The water-repellant band thus formed can prevent fuel or water or the like, which is formed as a result of combustion, from depositing on the surface of the insulator 2, so that more effective prevention of smear due to deposition of carbon and the like is feasible (the fourth embodiment). As is shown in FIG. 4, it is possible to prevent water from depositing on the surface of the insulator 2 and hence to eliminate one of causes for the deposition of carbon by coating a water-repellant material 9 on an inner wall 15 of the metal shell 4 at an area facing the band 8 coated or baked on the surface of the basal part 14 of the insulator 2 (the fifth embodiment).

Figure 5:
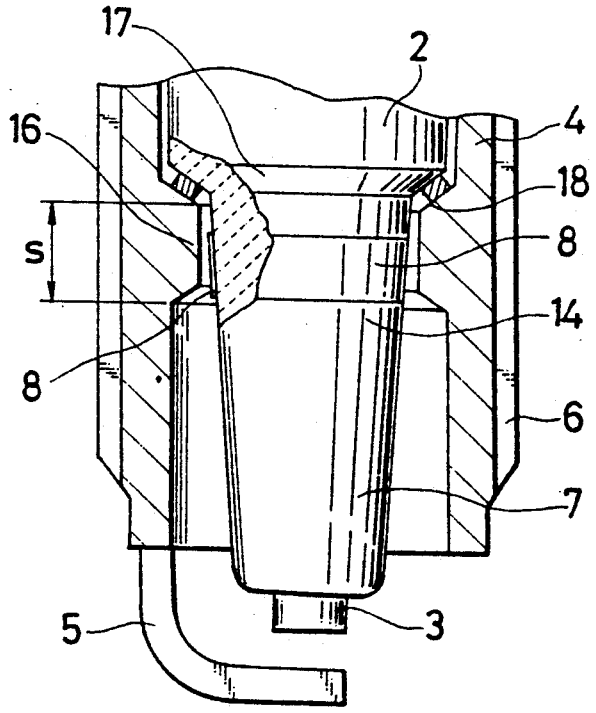
FIG. 5 is an enlarged, partly cross-sectional, fragmentary view of a spark plug according to a sixth embodiment of the present invention.

In FIG. 5, the band 8 is formed on the surface of the basal part 14 of the leg portion 7 of the insulator 2 by coating or baking, and the axial length s of a shelf portion 16 of the metal shell, said shelf portion 16 forming at an upper surface thereof the shoulder seat 18 for the insulator 2, is made longer in the axial direction than the length of the band 8. This can reduce the intrusion of carbon to the basal part 14 of the insulator 2, whereby the smear resistance can be improved further (the sixth embodiment). In this sixth embodiment, the water-repellant material 9 can also be coated on the inner wall 15 of the metal shell 4 as in the fifth embodiment. Still better smear preventing effect can be obtained in this case.

Figure 9:
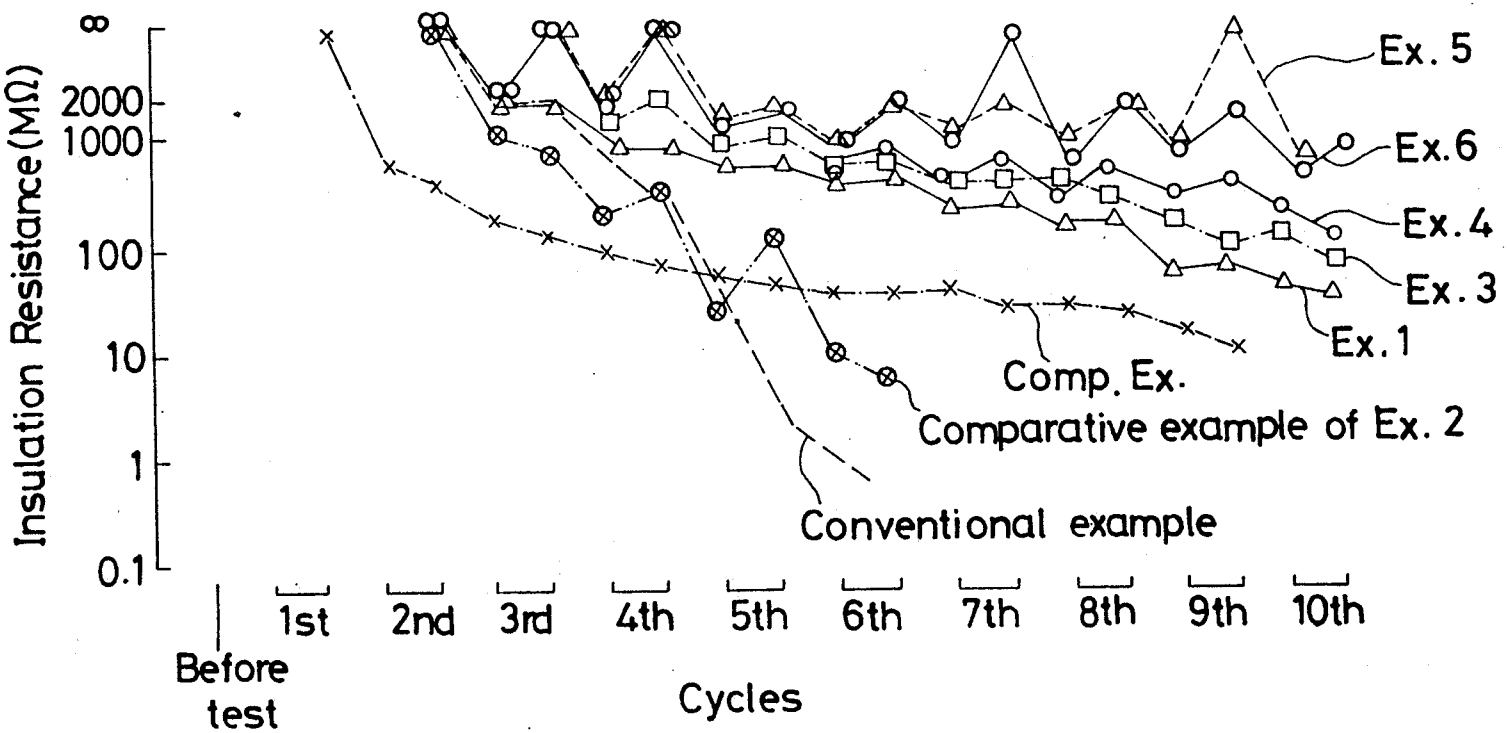
FIGS. 9 and 10 diagrammatically illustrate results of smear tests.

As is shown in Table 1, predelivery smear tests in which a drive pattern consisting of a vehicle speed of 35 km/hr×60 sec, an idling period of 20 sec and a vehicle speed of 15 km/hr×40 sec was repeated as a single cycle were conducted at a low temperature of 10° C. on the spark plugs of the invention examples, those of comparative examples and a conventional example, using a commercial car equipped with a 4-cycle, 2,000 cc internal combustion engine. The effects of the spark plugs of the invention examples were demonstrated as shown in FIG. 9.

TABLE 1

| | Specification | | | |
|---|---|---|---|---|
| | Length of leg portion | Axial length of shelf portion | Band | |
| Sample | (l, mm) | (s, mm) | Length (t, mm) | Resistance (MΩ/mm) |
| Comparative example | 17 | 2.5 | 4 | 100 |
| Example 1 | 17 | 2.5 | 4 | 1000 |
| Comparative product of Example 2 | 17 | 2.5 | 8 | 1000 |
| Example 3 | 17 | 2.5 | 2 | 1000 |
| Example 4 | 17 | 2.5 | 4 | 1000* |
| Example 5 | 17 | 2.5 | 4 | 1000** |
| Example 6 | 17 | 5 | 2 | 1000** |
| Conventional example | 17 | 2.5 | No coating | |

*The band was water-repellant.
**The inner wall of the metal shell was coated with a water-repellant material.

As a result of the smear tests, the following finding was obtained. The insulation resistance of the conventional spark plug provided with no semiconductor band dropped abruptly from the third cycle, and decreased to 1 MΩ and misfired in the sixth cycle. In contrast, the insulation resistance dropped only slowly in the case of the spark plugs of the first, third, fourth, fifth and sixth embodiments of the present invention, thereby demonstrating good smear resistance. As the resistance of the semiconductor material, the range of $5\times10^2-5\times10^4$ MΩ/mm is particularly preferred. As is readily understood from the comparative example, 100 MΩ/mm are too low to exhibit sufficient smear resistance because the insulation resistance gradually drops as more cycles are performed. Further, as is indicated by the comparative product of the second embodiment, the insulation resistance drops sharply and the band 8 is not effective for the prevention of smear if the length t of the band 8 is about 50% of the length l of the leg portion 7. The suitable band length t is therefore not greater than one third of the length l of the leg portion 7. The band 8 is more effective for the prevention of smear when provided in the form of a ring within the above range t on the basal part 14 other than the root part 17 as demonstrated by the third embodiment. In addition, it is more effective to impart water repellency to the band 8 as demonstrated by the fourth embodiment. Still better smear resistance can be obtained when water repellency is imparted to the inner wall of the metal shell 4 as in the fifth embodiment or the axial length s of the shelf portion 16 of the metal shell 4 is made longer as in the sixth embodiment. Especially, the sixth embodiment is easy to manufacture and is hence useful because it is only necessary to change the machining dimensions of the shelf portion 16.

Figure 6:
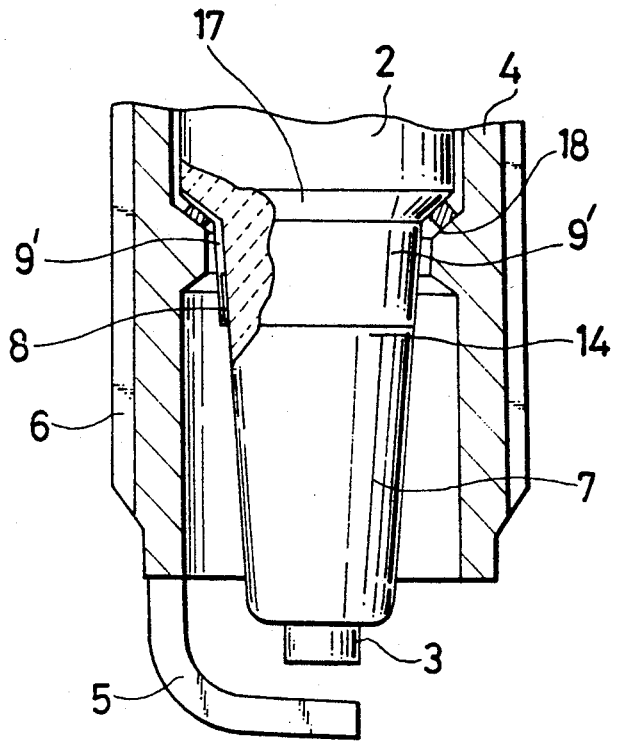
FIG. 6 is an enlarged, partly cross-sectional, fragmentary view of a spark plug according to a seventh embodiment of the present invention.

In the seventh embodiment illustrated in FIG. 6, the band 8 made of the semiconductor material whose resistance is $5\times10^2-5\times10^4$ MΩ/mm is provided on an upper peripheral surface of the leg portion 7 of the insulator 2 having the center electrode 3 at the free end thereof and the band 8 and basal part 17 are both covered by a water-repellant insulating coating 9'. When carbon is formed and is about to deposit together with raw gas, water and/or the like on the surface of the insulator 2, the deposition of water is hard to occur because of the water-repellant insulating coating 9'. Even if water deposits together with carbon, the carbon deposited together with the water is prevented from being electrically oriented by impressed voltages because the band 8 of the semiconductor material having the resistance of $5\times10^2-5\times10^4$ MΩ/mm is provided on the upper peripheral surface of the insulator 2. As a result, it is possible to prevent the reduction of the insulation resistance which would be caused by the deposition of carbon (carbon smear) on the surface of the insulator 2.

This band (8) of the semiconductor material has been formed by mixing alumina or silica as a principal component with 0.1-5% of the semiconductor material [$TiO_2$, $Nb_2O_5$, $ZrO_2$, $BaTiO_3$, $IrO_2$, or a ferrite represented by $MO.Fe_2O_3$ (M: Mn, Mg, Ni, Co, Cu, Zn or the like)], coating the mixture, drying the thus-coated mixture in the air for 1 hour and then baking it at 100°-300° C. or by coating a mixture of at least two oxides selected from lanthanum oxide, chromium oxide, cupric oxide, ferrous oxide and ferric oxide and then baking the thus-coated mixture at 1,250°-1,370° C. for 10 minutes. The insulating coating 9' covering the surface of the band 8 has been formed by applying a coating formulation of silicone or a silicone varnish and fine particles of boron nitride dispersed therein and then drying and solidifying the thus-applied coating formulation at ambient temperature and moisture for 1-12 hours.

Figure 7:
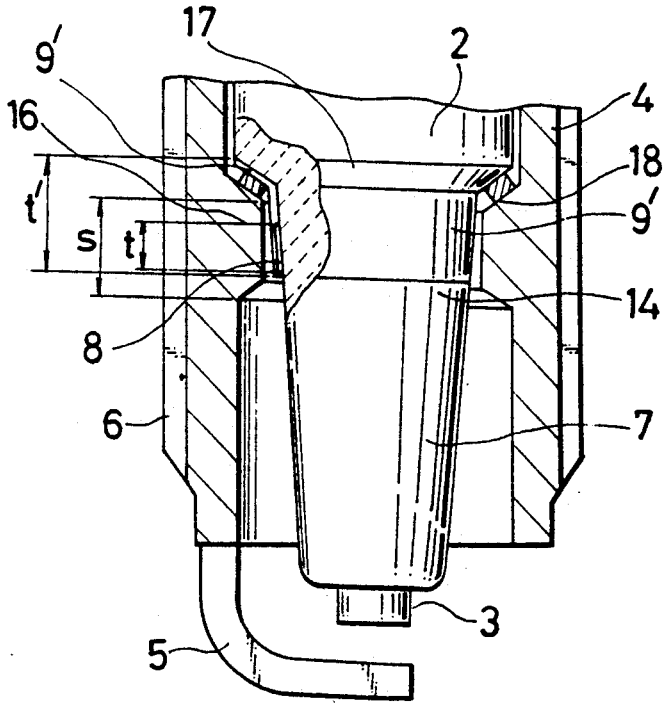
FIG. 7 is an enlarged, partly cross-sectional, fragmentary view of a spark plug according to an eighth embodiment of the present invention.
Figure 8:
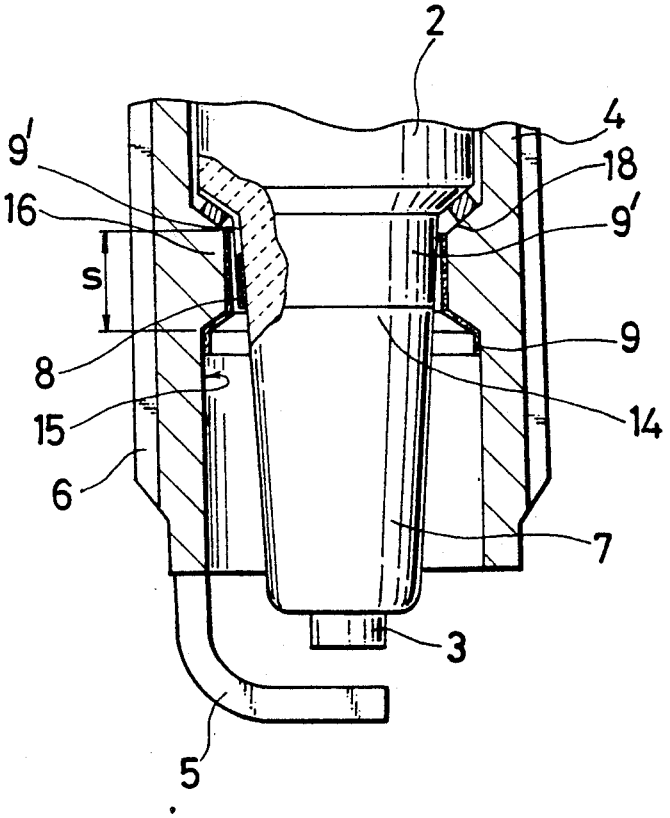
FIG. 8 is an enlarged, partly cross-sectional, fragmentary view of a spark plug according to a ninth embodiment of the present invention.

It is also possible to prevent the intrusion of carbon, water and the like to the basal part 14 of the leg portion 7 of the insulator 2 and hence to improve the smear resistance by making the axial length s of the shelf portion 16 of the metal shell 4, said shelf portion 16 supporting the insulator 2 thereon, longer than the axial length of the band 8 made of the semiconductor material as shown in FIG. 7 (the eighth embodiment). It is possible to completely eliminate water and the like, which promote the deposition of carbon, by coating a water-repellant material to the surface of the inner wall 15 of the metal shell 4 as shown in FIG. 4 (the ninth embodiment).

Figure 10:
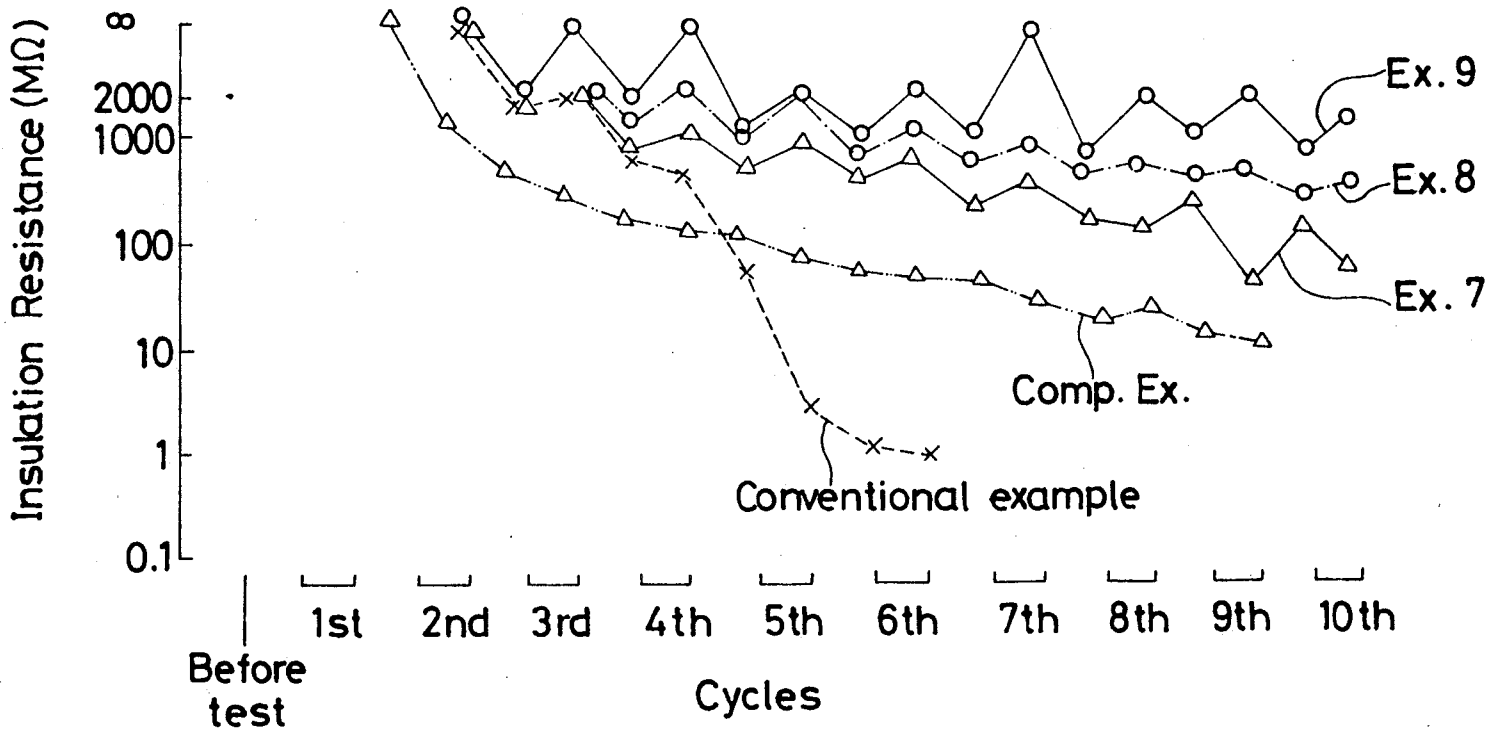

As is shown in Table 2, predelivery smear tests in which a drive pattern consisting of a vehicle speed of 35 km/hr×60 sec, an idling period of 20 sec and a vehicle speed of 15 km/h×40 sec was repeated as a single cycle were conducted at a low temperature of 10° C. on the spark plugs of the invention examples, that of the comparative example and a conventional example, using a commercial car equipped with a 4-cycle, 2,000 cc internal combustion engine. The effects of the spark plugs of the invention examples were demonstrated as shown in FIG. 10.

TABLE 2

| | Specification | | | | |
|---|---|---|---|---|---|
| | | Axial | Insulating coating | | |
| Sample | Length of leg portion (l, mm) | length of shelf portion (s, mm) | Length of band (t, mm) | Length of water-repellant coating (t', mm) | Resistance (MΩ/mm) |
| Comparative Example | 17 | 2.5 | 2.0 | 4.5 | 100 |
| Example 7 | 17 | 2.5 | 2.0 | 4.5 | 1000 |
| Example 8 | 17 | 5.0 | 2.0 | 4.5 | 1000 |
| Example 9 | 17 | 5.0 | 2.0 | 4.5 | 1000* |
| Conventional example | 17 | 2.5 | | No coating | |

*The inner wall of the metal shell was coated with a water-repellant material.

As a result of the smear tests, the following finding was obtained. The insulation resistance of the conventional spark plug provided with neither a semiconductor band nor a water-repellant insulating coating dropped abruptly from the third cycle, and decreased to 1 MΩ and misfired in the sixth cycle. In contrast, the insulation resistance dropped only slowly in the case of the spark plugs of the seventh, eighth and ninth embodiments of the present invention, thereby demonstrating good smear resistance. As the resistance of the semiconductor material, the range of $5\times10^2-5\times10^4$ MΩ/mm is particularly preferred. As is readily understood from the comparative example, the insulation resistance of the 100 MΩ/mm band imparted with water repellency dropped as more cycles were performed. It cannot therefore exhibit sufficient smear resistance. When the axial dimension s of the shelf portion 16 of the metal shell 4 is made longer than the axial length of the band 8, the intrusion of carbon to the basal part 14 of the leg portion 7 of the insulator 2 is prevented, whereby the deposit of carbon is minimized and the smear resistance can be improved further. Further, the coating of the inner wall 15 of the metal shell 4 with the water-repellant material is effective for preventing water and the like from intruding to the basal part 14 of the leg portion 7, so that the smear resistance can be improved further.

What is claimed is:

1. In a spark plug for an internal combustion engine, said spark plug having a metal shell and an insulator, said metal shell defining a through hole and a shoulder seat and having threads for mounting the spark plug on the internal combustion engine, said insulator being disposed inside the through hole of the metal shell, fixed on the shoulder seat and holding a center electrode therein, and said insulator having a leg portion extending from the should seat into a combustion chamber of the internal combustion engine when the spark plug is mounted on the internal combustion engine, the improvement wherein a semiconductor material having a resistance of $5\times10^2-5\times10^4$ MΩ/mm is applied in the form of a band on the peripheral surface of a basal part of the leg portion of the insulator, said band being not longer than one-third of the overall length of the leg portion and being located opposite to the shoulder seat within the metal shell.

2. The spark plug according to claim 1, wherein the semiconductor material is coated or baked.

3. The spark plug according to claim 1, wherein the band has water repellency.

4. The spark plug according to claim 1, wherein an inner wall of the metal shell is coated with a water-repellant material at an area facing at least the peripheral surface of the basal part of the leg portion of the insulator.

5. In a spark plug for an internal combustion engine, said spark plug having a metal shell and an insulator, said metal shell defining a through hole and a shoulder seat and having threads for mounting the spark plug on the internal combustion engine, said insulator being disposed inside the through hole of the metal shell, fixed on the shoulder seat and holding a center electrode therein, and said insulator having a leg portion extending from the shoulder seat into a combustion chamber of the internal combustion engine when the spark plug is mounted on the internal combustion engine, the improvement wherein a semiconductor material having a resistance of $5\times10^2-5\times10^4$ MΩ/mm is applied in the form of a band on the peripheral surface of a basal part of the leg portion of the insulator, said band being not longer than one-third of the overall length of the leg portion, wherein the shoulder seat is formed on an upper surface of a shelf portion of the metal shell and the shelf portion has an axial length longer than that of said band.

6. The spark plug according to claim 5, wherein said band is located opposite to the shoulder seat within the metal shell.

7. In a spark plug for an internal combustion engine, said spark plug having a metal shell and an insulator, said metal shell defining a through hole and a shoulder seat and having threads for mounting the spark plug on the internal combustion engine, and said insulator being disposed inside the through hole of the metal shell, fixed on the shoulder seat and holding a center electrode therein, and said insulator having a leg portion extending from the shoulder seat into a combustion chamber of the internal combustion engine when the spark plug is mounted on the internal combustion engine, the improvement wherein a semiconductor material having a resistance of $5\times10^2-5\times10^4$ MΩ/mm is applied in the form of a band on the peripheral surface of a basal part of the leg portion of the insulator, said band being not longer than one-third of the overall length of the leg portion and being located opposite to the shoulder seat within the metal shell, and at least the basal part of the leg portion, including the band, being covered with a water-repellant insulating coating.

8. The spark plug according to claim 7, wherein the semiconductor material is coated or baked.

9. The spark plug according to claim 7, wherein an inner wall of the metal shell is coated with a water-repellant material.

10. In a spark plug for an internal combustion engine, said spark plug having a metal shell and an insulator, said metal shell defining a through hole and a shoulder seat and having threads for mounting the spark plug on the internal combustion engine, and said insulator being disposed inside the through hole of the metal shell, fixed on the shoulder seat and holding a center electrode therein, and said insulator having a leg portion extending from the shoulder seat into a combustion chamber of the internal combustion engine when the spark plug is mounted on the internal combustion engine, the improvement wherein a semiconductor material having a resistance of $5\times10^2-5\times10^4$ MΩ/mm is applied in the form of a band on the peripheral surface of a basal part of the leg portion of the insulator, said band being not longer than one-third of the overall length of the leg portion, and at least the basal part of the leg portion, including the band, being covered with a water-repellant insulating coating, wherein the shoulder seat is formed on an upper surface of a shelf portion of the metal shell and the shelf portion has an axial length longer than that of the band.

11. The spark plug according to claim 10, wherein said band is located opposite to the shoulder seat within the metal shell.

12. In a spark plug for an internal combustion engine, said spark plug having a metal shell and an insulator, said metal shell defining a through hole and a shoulder seat and having threads for mounting the spark plug on the internal combustion engine, and said insulator being disposed inside the through hold of the metal shell, fixed on the shoulder seat and holding a center electrode therein, and said insulator having a leg portion extending from the shoulder seat into a combustion chamber of the internal combustion engine when the spark plug is mounted on the internal combustion engine, the improvement wherein a semiconductor material having a resistance of $5\times10^2-5\times10^4$ MΩ/mm is coated or baked in the form of a band on the peripheral surface of a basal part of the leg portion of the insulator, at least the basal part of the leg portion, including the band, being covered with a water-repellant insulating coating, the shoulder seat being formed on an upper surface of a shelf portion of the metal shell, and the shelf portion having an axial length longer than that of the band.

13. The spark plug according to claim 12, wherein said band is located opposite to the shoulder seat within the metal shell.

14. The spark plug according to claim 12, wherein said band is not longer than one third of the overall length of said leg portion.

15. The spark plug according to claim 12, wherein said band is not longer than one third of the overall length of said leg portion and is located opposite to the shoulder seat within the metal shell.

* * * * *